US006464205B2

(12) United States Patent
Wanner

(10) Patent No.: US 6,464,205 B2
(45) Date of Patent: Oct. 15, 2002

(54) SCISSORS-TYPE LIFTING PLATFORM

(75) Inventor: Hubert Wanner, Haldenwang (DE)

(73) Assignee: MAHA Maschinenbau Haldenwang GmbH & Co. KG, Haldenwang (DE)

( * ) Notice: Subject to any disclaimer, the term of this patent is extended or adjusted under 35 U.S.C. 154(b) by 0 days.

(21) Appl. No.: 09/726,003

(22) Filed: Nov. 29, 2000

(65) Prior Publication Data

US 2001/0025952 A1 Oct. 4, 2001

(30) Foreign Application Priority Data

Nov. 29, 1999 (DE) ..... 299 20 934

(51) Int. Cl.[7] ..... B66F 3/22
(52) U.S. Cl. ..... 254/122
(58) Field of Search ..... 254/8 R, 8 B, 254/8 C, 9 R, 9 B, 9 C, 10 R, 10 B, 10 C, 122, 124

(56) References Cited

U.S. PATENT DOCUMENTS 2,899,172 A 8/1959 Cresci
5,192,053 A 3/1993 Sehlstedt

FOREIGN PATENT DOCUMENTS

| | | |
|---|---|---|
| DE | 89 15 859.8 | 12/1991 |
| DE | 92 05 900.7 | 11/1992 |
| DE | 93 02 967.5 | 6/1993 |
| DE | 196 13 341 | 10/1997 |

*Primary Examiner*—Robert C. Watson
(74) *Attorney, Agent, or Firm*—The Maxham Firm

(57) ABSTRACT

A scissors-type lifting platform, in particular for motor vehicles. The lifting platform has at least one horizontal bearer element for the load to be lifted and a scissors arrangement on the underside of the bearer element. The scissors arrangement has scissors spars which are swivellably connected with one another and are supported on a base plate. An expansion lever is rotatably hinged on one of the scissors spars and is actuatable by means of an actuating element for the purpose of swivelling the scissors spars. A supporting surface for supporting a support device is arranged on the other scissors spar. According to the invention, the technically simple and particularly wear-resistant expansion mechanism has at least one rotatably lodged rolling body for the support of the expansion lever.

11 Claims, 4 Drawing Sheets

SCISSORS-TYPE LIFTING PLATFORM

BACKGROUND

1. Field of the Invention

The invention generally concerns a scissors-type lifting platform for motor vehicles and more particularly relates to a relatively simple, quiet, wear resistant lifting platform.

2. Background Discussion

In their "down" position, scissors-type lifting platforms should be as low as possible in order to facilitate the positioning of the load to be lifted. In particular, lifting platforms for motor vehicles should, when in their "down position," project as little as possible above the floor in order to facilitate the driving on of the vehicles. In the case of typical scissors-type lifting platforms there also, however, arises the problem that the scissors spars, which are able to swivel against one another, in the starting phase of the lifting movement an unfavorable lever geometry can be created for the lifting device.

To solve this problem, known scissors-type lifting platforms used a so-called expansion lever which expands over the scissors-type lifting platform rod assembly in the starting phase of the lifting movement.

German Utility Model 92 05 900 describes a scissors-type lifting platform with an expansion lever of this type. In the case of this lifting platform, the expansion lever, which is swivellably supported on one scissors spar is, however, supported on a counterplate which is arranged on the other scissors spar. Through the sliding movement of the expansion lever on the counterplate, high mechanical stresses ensue, in particular in the case of a heavy load, which can lead to increased wear on the sliding surfaces. Replacement of the elements which slide over one another is costly and associated with correspondingly high costs of material and maintenance.

SUMMARY OF THE INVENTION

It is accordingly a primary purpose of the invention to provide a scissors-type lifting platform with a wear-resistant and easily maintained expansion mechanism. This purpose is accomplished according to the invention by means of the support device containing at least one rotatably lodged cylinder body for supporting the expansion lever.

In the scissors-type lifting platform according to the invention, during the swivelling process of the scissors spar, the expansion lever rolls away from the lowest position on one or more rotatably supported rolling bodies, which substantially reduces friction. It is therefore possible to avoid the use of costly high-grade materials or the use of exchangeable sliding plates. It is moreover possible to avoid noises created in conventional expansion mechanisms by sliding friction between the expansion lever and the counterplate, particularly in dry running. By means of the roll-away movement of the expansion lever over the rolling bodies according to the invention, it is possible to avoid extensive wear and a disturbing noise.

In a particularly advantageous embodiment, the support device has, for example, two support cylinders lying next to one another to act as rolling bodies. The support surface of the expansion lever is made in the form of steps so that, for example, the expansion lever, which is actuated by a pressure medium cylinder can, during the process of the rise of the lifting platform, first be supported on the first support cylinder and then on the second one. The lever action of the expansion lever during the process of expansion is thereby optimized.

According to another useful embodiment of the invention, the scissors spars can have two scissors arms parallel to one another, which can be connected by cross-supports or the like. The scissors spars can, however, also be of a different design.

In a particularly stable embodiment, the support cylinders can be rotatably supported via bearing bushings in two parallel bearing supports on one of the scissors spars.

In the configuration of scissors spars with parallel scissors arms, the bearing supports can, for example, be arranged on a connecting plate between the two scissors arms.

BRIEF DESCRIPTION OF THE DRAWING

The objects, features and benefits of the invention will become more clear from the following description, when read in conjunction with the accompanying drawing, wherein.

DETAILED DESCRIPTION OF THE PREFERRED EMBODIMENTS

Figure 1:
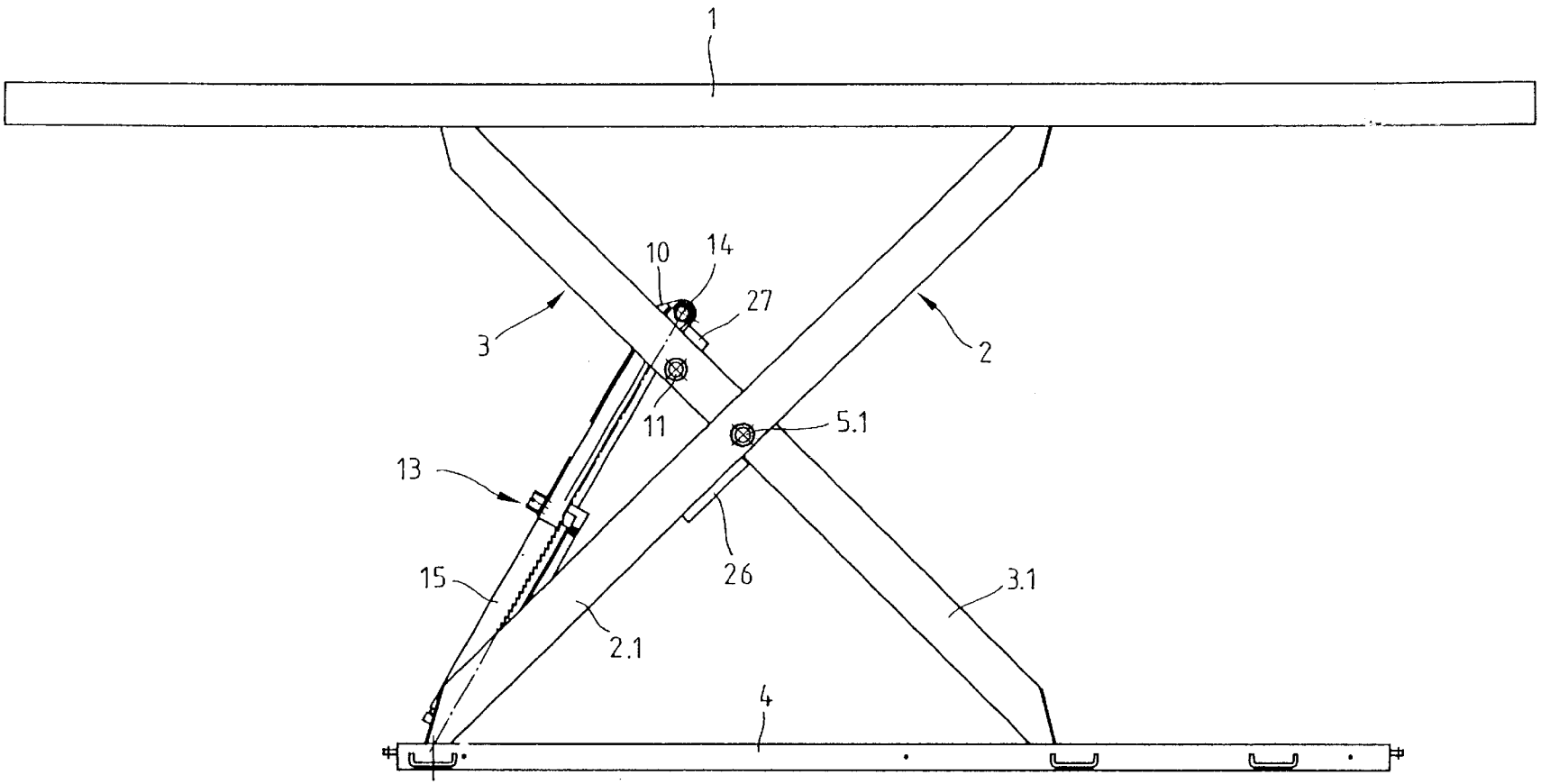
FIG. 1 is a schematic side view of a scissors-type lifting platform of the invention in its its lifted position.

The schematically illustrated side view of the scissors-type lifting platform in FIG. 1 contains horizontal bearer element 1 for the loads which are to be lifted, and a scissors arrangement on its underside. Scissors spars 2 and 3 can be swivelled against one another and are supported on base plate 4, having the form of a rail or the like and which may consist of several parts. In the illustrated embodiment, each of the two scissors spars 2 and 3 has two scissors arms 2.1 and 2.2 or 3.1 and 3.2 parallel and spaced from one another. Both front scissors arms 2.1 and 3.1 are shown in side view in FIG. 1 and the rear scissors arms 2.2 and 3.2 are shown in sectional view in FIG. 2. The central parts of the scissors arms 2.1 and 3.1 or 2.2 and 3.2 of the two scissors spars 2 and 3 are swivellably connected to one another by means of hinge bolts 5.1 and 5.2, where the upper ends of the scissors arms are arranged on bearer element 1 and the lower ends on base plate 4.

As shown in FIG. 2, the two lower ends of scissors arms 2.1 and 2.2 of scissors spar 2 are swivellably joined to base plate 4 via peg 6, while the upper ends are arranged in horizontally movable manner by means such as guide roller 7, a sliding block or the like, on the underside of bearer element 1. In the case of both scissors arms 3.1 and 3.2 of scissors spar 3, the upper ends are, on the other hand, hinged through peg 8 to the bearer element and the lower ends arranged via guide roller 9 or the like in horizontally movable manner to base plate 4.

Between the two internally arranged scissors arms 3.1 and 3.2, there is angled expansion lever 10 which is specially shown in FIGS. 2A to 2D, and peg 11 which is swivellably mounted next to hinge bolts 5.1 and 5.2. On the upward-pointing bent left end of the lever arm of expansion lever 10, shown in FIGS. 2A to 2D, is piston rod 12 of pressure medium cylinder 13, hinged by means of hinge bolt 14. Housing 15 of the pressure cylinder is swivellably arranged between the inner scissors arms 3.1 and 3.2 in the area of peg 6 by means of hinge bolt 16. On the right end of the lever arm of expansion lever 10, there is a supporting surface 17 with two steps to be supported on two support cylinders 18 and 19 rotatably arranged between the scissors arms 2.1 and 2.2 on scissors spar 2.

Figure 2C:
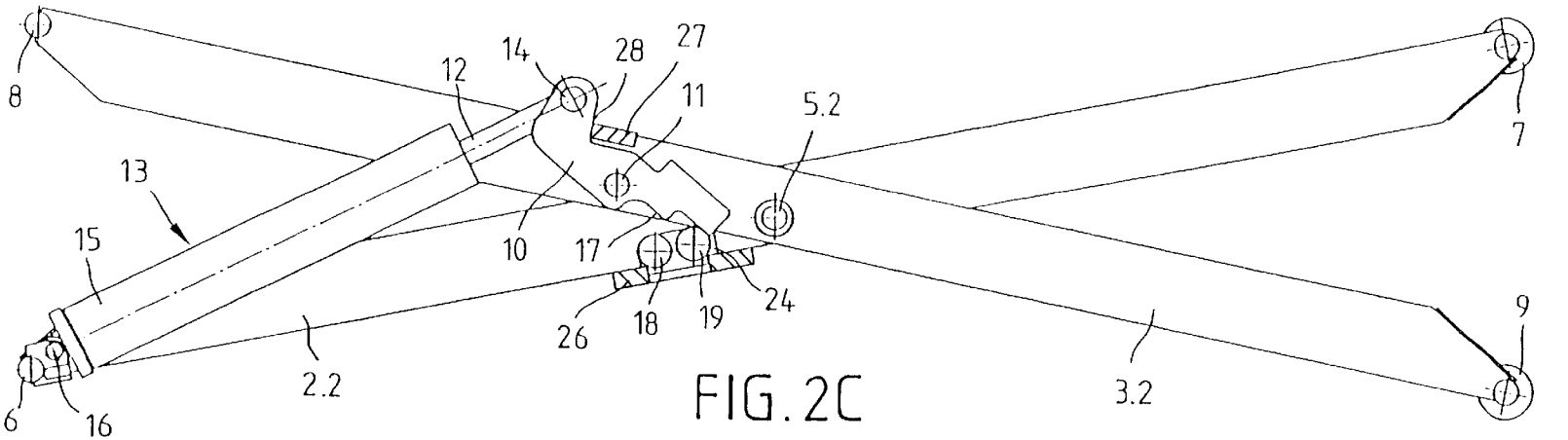
FIGS. 2A–2D are various longitudinal views of lift positions of a scissors arrangement of the scissors-type lifting platform of FIG. 1.
Figure 2B:
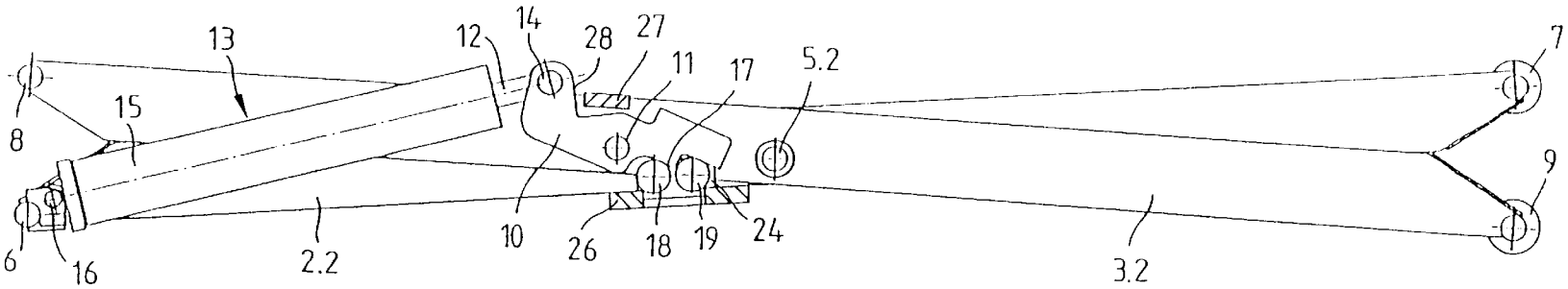
Figure 2A:
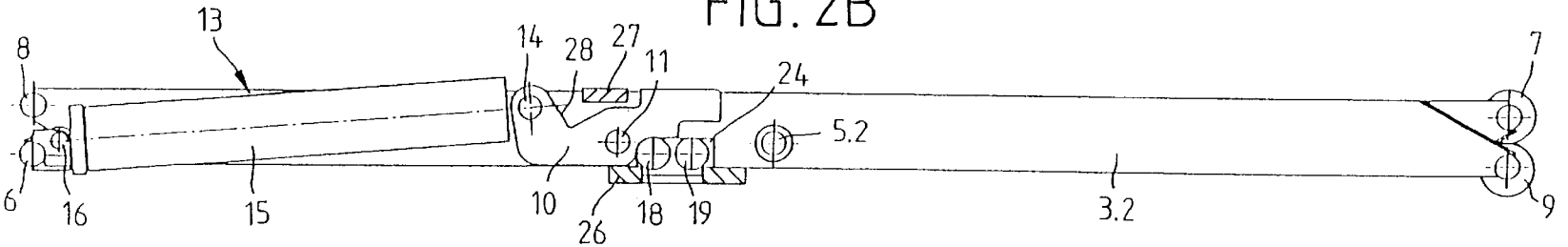
Figure 2D:
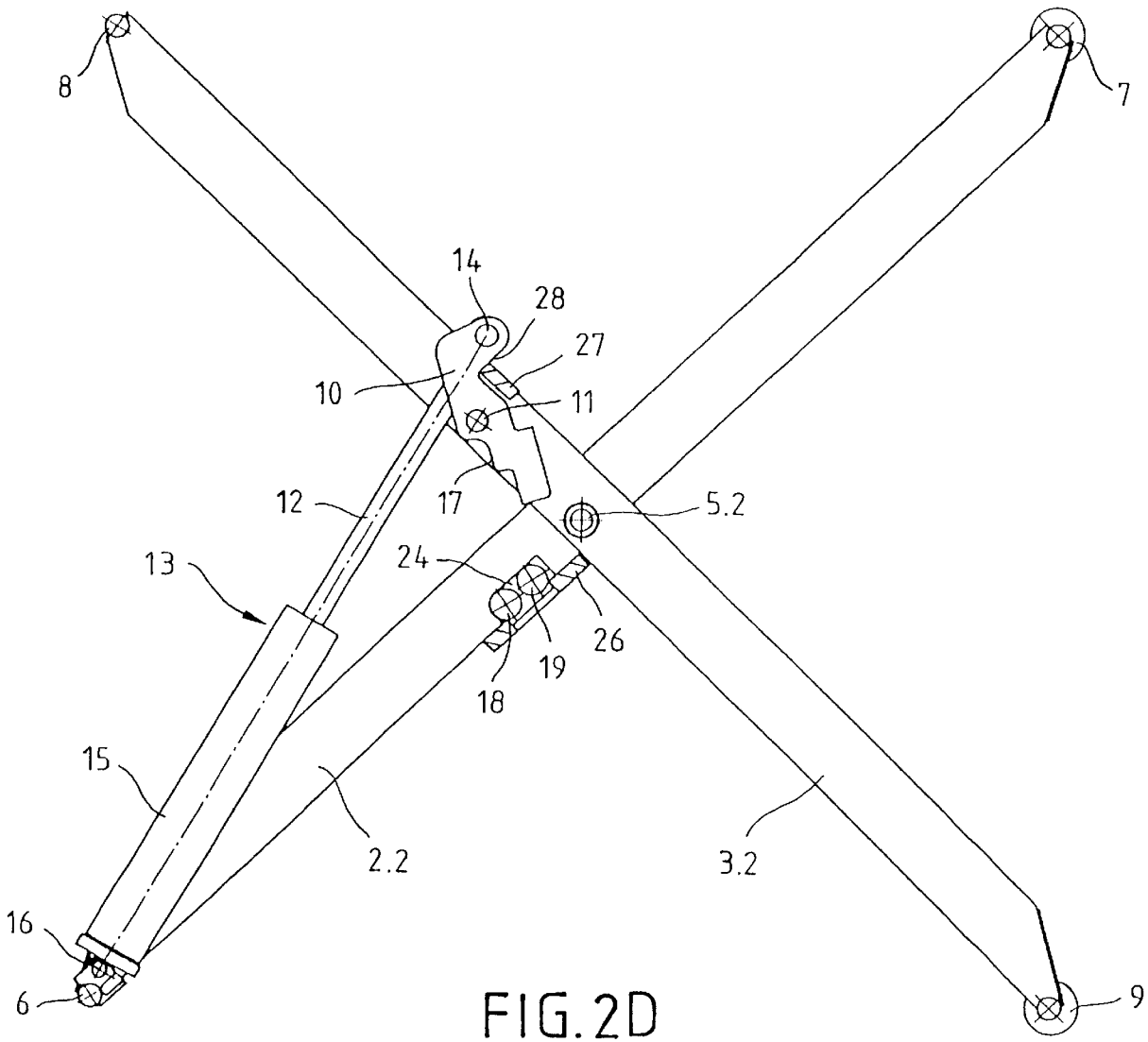
Figure 3:
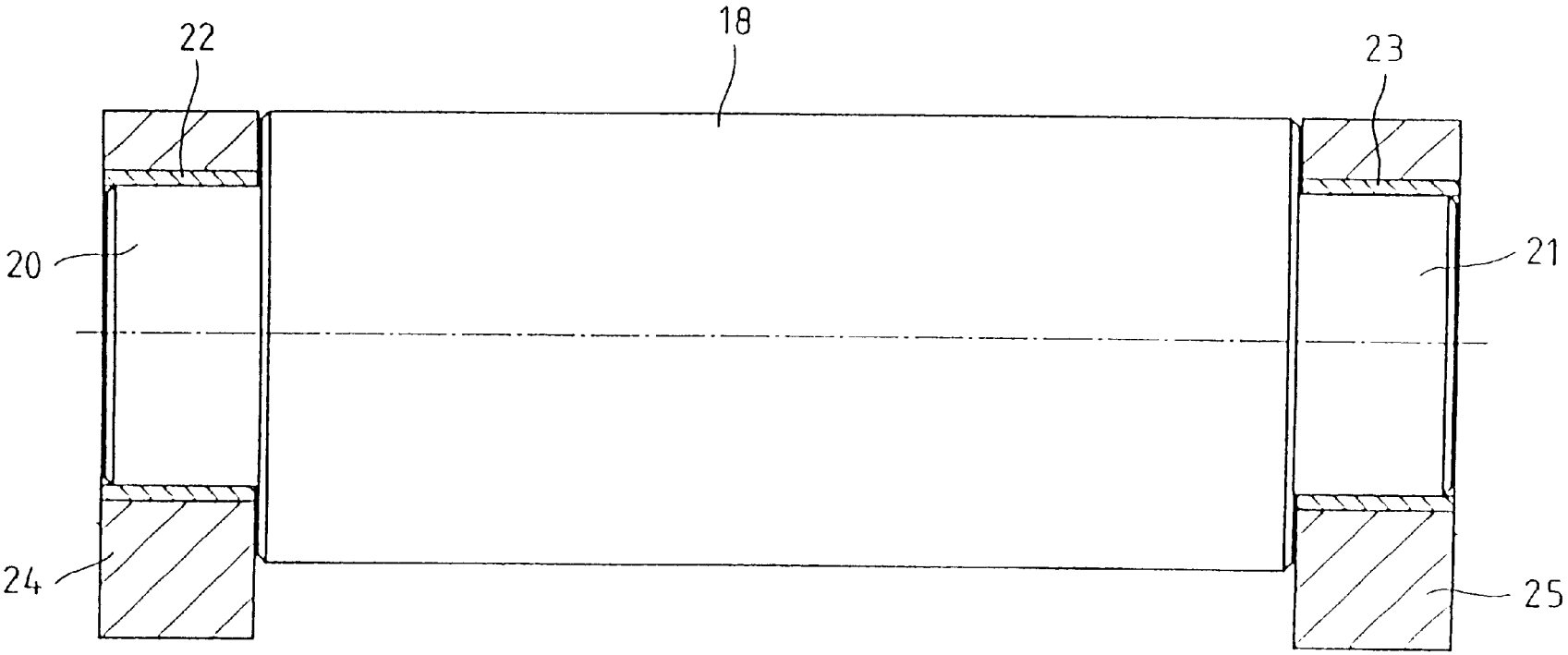
FIG. 3 is a cross sectional view of a sliding cylinder used in the scissors-type lifting platform of FIG. 1.

As can be seen in FIG. 3, support roll 18 has end bearing journals 20 and 21 through which the support roll is lodged in two parallel bearing supports 24 and 25 via bearing bushings 22 and 23. Support roll 19 has the same supported configuration. Bearing supports 24 and 25 are separated by the outer scissors arms 2.1 and 2.2 on the upper side of connection plate 26, illustrated in FIGS. 1 and 2, and arranged between the two outer scissors arms 2.1 and 2.2. The distance of bearing supports 24 and 25 from the outer scissors arms is so chosen that inner scissors arms 3.1 and 3.2 fit into the lowest position between the bearing supports and the outer scissors arms. In this way, both scissors spars 2 and 3 can be swivelled into a horizontal position. Between the two inner scissors arms 3.1 and 3.2, impact plate 27 is arranged on which expansion lever 10 is supported by supporting surface 28 after reaching the intermediate position shown in FIG. 2C for further lifting of bearer element 1.

When the scissors arrangement of the lifting platform is raised from the "down" position shown in FIG. 2A by means of the impact of pressure cylinder 13, expansion lever 10 performs a clockwise rotation movement about peg 11, where the expansion lever first rolls away on support roll 18 as it engages the first step of supporting surface 17. When cylinder rod 12 extends further, the second step of the supporting surface of the expansion lever reaches second support cylinder 19 as shown in FIG. 2B. Expansion lever 10 then rolls away, with the second step of support surface 17 on support cylinder 19 until the scissors arrangement reaches an intermediate position illustrated in FIG. 3C. In this position, support surface 28 of expansion lever 10 strikes on impact plate 27 and continued lift movement to the upper lift position shown in FIG. 2D through the further extension of piston rod 12, takes place without any additional rotation of expansion lever 10.

The presently described scissors-type lifting platform is characterized by a particularly wear-resistant and maintenance-friendly expansion mechanism, without resulting disturbing noises when loads are lifted.

The invention is not restricted to the presently described embodiment. For example, a scissors-type lifting platform with a multiple scissors arrangement can have an expansion mechanism according to the invention. Moreover, other, actuating elements can be provided in replacement of the pressure medium cylinder for swivelling the expansion lever.

What is claimed is:

1. A scissors-type lifting platform for motor vehicles, the lifting platform comprising:

at least one horizontal bearer element for loads to be lifted;

a scissors arrangement on the underside of said bearer element, said scissors arrangement having scissors spars which are supported on a base plate and are swivellably linked together;

an actuation element;

an expansion lever actuatable by said actuation element for swivelling said scissors spars, said expansion lever being rotatably hinged on one of said scissors spars, said expansion lever being formed with a supporting surface for the support of a support device arranged on the other of said scissors spar; and a support device comprising at least one rotatably mounted rolling body for the support of said expansion lever, wherein said support device comprises two rolling bodies next to one another, said supporting surface of said expansion lever being formed in the shape of steps for support on said two rolling bodies.

2. The lifting platform according to claim 1, wherein said rolling bodies are support cylinders rotatably mounted on said other scissors spar.

3. The lifting platform according to claim 1, wherein each of said scissors spars comprises two parallel scissors arms.

4. The lifting platform according to claim 3, wherein said scissors arms are swivellably connected to one another through hinge bolts.

5. The lifting platform according to claims 3 or 4, and further comprising:

a connecting plate between said scissors arms; wherein said rolling bodies are support cylinders rotatably mounted on said other scissors spars; and said support cylinders are arranged on two parallel bearing supports on the upper side of said connecting plate.

6. The lifting platform according to claim 5, wherein said support cylinders are rotatably hinged in said bearing supports by means of bearing bushings.

7. The lifting platform according to one of claims 1, 3 or 4 and further comprising:

an impact plate mounted to one of said scissors spars;

wherein said expansion lever is formed with a supporting surface for support on said impact plate.

8. The lifting platform according to one of claims 1, 3 or 4, wherein said actuation element is a pressure medium cylinder.

9. The lifting platform according to claim 5, wherein said actuation element is a pressure medium cylinder.

10. The lifting platform according to claim 6, wherein said actuation element is a pressure medium cylinder.

11. The lifting platform according to claim 7, wherein said actuation element is a pressure medium cylinder.

* * * * *